United States Patent [19]

Chapman et al.

[11] 4,222,556

[45] Sep. 16, 1980

[54] SHEET FEEDING APPARATUS UTILIZING A SPIRALLY SLOTTED STACKING WHEEL

[75] Inventors: Christopher P. Chapman, Hayling Island; David G. Boulter, Clanfield, both of England

[73] Assignee: De La Rue Systems Limited, London, England

[21] Appl. No.: 952,182

[22] Filed: Oct. 17, 1978

[30] Foreign Application Priority Data

Oct. 19, 1977 [GB] United Kingdom ..... 43531/77

[51] Int. Cl.[2] ..... B65H 29/24; B65H 29/40; B65H 31/06; B65H 1/02

[52] U.S. Cl. ..... 271/3.1; 271/173; 271/196; 271/214; 271/307; 271/315; 414/104; 414/107

[58] Field of Search ..... 271/187, 196, 80, 81, 271/214, 3.1, DIG. 2, 174, 178, 314, 315, 307, 312, 313; 414/107, 104, 106, 87

[56] References Cited

U.S. PATENT DOCUMENTS

| | | | |
|---|---|---|---|
| 3,049,346 | 8/1962 | Evansen | 271/4 |
| 3,116,668 | 1/1964 | Novick | 271/187 X |
| 3,162,439 | 12/1964 | Poland et al. | 271/187 |
| 3,355,169 | 11/1967 | Seyl | 271/187 |
| 3,545,746 | 12/1970 | Ledger et al. | 271/196 |
| 3,682,473 | 8/1972 | Kuyt | 271/3.1 X |

*Primary Examiner*—Bruce H. Stoner, Jr.

*Attorney, Agent, or Firm*—Sughrue, Rothwell, Mion, Zinn and Macpeak

[57] ABSTRACT

In a sheet stacking system employing a spirally slotted wheel and a stripping plate to remote sheets from the wheel and form them into a stack, the sheets are conveyed to the stacking wheel by a vacuum drum having a slot around its circumference into which extends the extremity of the stacking wheel. The sheet continues to be held on the drum surface by the vacuum until it encounters the stacking wheel extremity which, by virtue of the lower peripheral speed of the stacking wheel, acts against the vacuum to strip the sheet from the drum. The stacking wheel axis may be mounted for pivotal movement about the vacuum drum axis to accommodate different output stack sizes, permitting the formation of a sheet store buffer.

14 Claims, 6 Drawing Figures

SHEET FEEDING APPARATUS UTILIZING A SPIRALLY SLOTTED STACKING WHEEL

BACKGROUND OF THE INVENTION

This invention relates to a high speed stacking device for delivering flexible sheets, for example, sheets of paper from a flowline to a stacking station.

This invention has particular utility in apparatus adapted for high speed handling of banknotes, for example, in a banknote-condition verifying machine in which mixed new and used banknotes are fed from a stack, examined by one or more analysing means, and thereafter routed to various stack forming devices in accordance with their condition. Such machines are required to handle large quantities of banknotes and it is therefore necessary to feed the banknotes at a high speed, for example, in the order of 20–25 banknotes per second. To permit the various routing devices to act individually on the banknotes adequate spaces must be formed between adjacent banknotes along the flowline, inevitably leading to a requirement for a high linear velocity. Special problems are encountered at each of the stacking stations because it is necessary to decelerate the banknotes up to a stationary support surface in a controlled progressive manner to ensure that uniform and aligned stacks are formed. Further problems arise when it becomes necessary to handle used banknotes because of their indeterminate condition, for example, they may be torn or partially folded, and furthermore, the structure of the paper may have weakened or been degraded through use, and this may impair the efficiency of a vacuum feed. In such circumstances it is possible for a bad banknote to deviate from its intended path or to skew at a stacking station with a consequential risk of jamming the flowline and arresting operation of the machine.

To facilitate the formation of uniform and aligned stacks at a stacking station it is known to provide a wheel having a sheet-receiving slots presenting openings substantially tangential to the wheel at points around the wheel periphery, the slots defining spiral paths for sheets of paper fed into the openings as the wheel rotates. The wheel is driven at a peripheral speed lower than that of the flow-line and in a direction such that the openings trail in the direction of rotation. Examples of such wheels are shown in British Pat. No. 988,382 in which the wheel is of a type formed by providing spirally extending slots in a disc, and British Pat. No. 852,005, in which the wheel is of a type having a hub to which suitably directed tines are attached to form the sheet-receiving slots and to define the spiral paths. Such devices are so disposed that each of the sheet-receiving slots is in turn presented tangentially to the flow-line so that a free leading end of a sheet fed along the flow-line, at a linear speed greater than that of the wheel periphery, enters the slot entrance presented thereto and the sheet is propelled into the slot. The sheet is decelerated as it progesses along the spiral path. The sheets in the slots are successively stripped off during continued revolution of the wheel to form a stack on a sheet support surface.

In the known forms of stacking apparatus employing slotted wheels, the sheets to be stacked are advanced between belts or rollers, for example, towards and into the slots. As explained above, sheets such as used banknotes are frequently in poor condition and their flimsiness and possible folding makes it difficult to feed them in a uniform manner into a slotted wheel to take advantage of the potential of the slotted wheel for uniform stacking.

BRIEF DESCRIPTION OF THE INVENTION

According to the present invention, apparatus for stacking flexible sheets includes a rotatable stacking wheel having slots presenting sheet-receiving openings substantially tangential to the wheel periphery and defining spiral paths for sheets fed into the slots as the wheel rotates, and a stack support means arranged for removing the sheets from the slots of the wheel and forming a stack therefrom, the apparatus further comprising a driven vacuum transportation drum for conveying the sheets from a flow path along an arcuate path to the stacking wheel, the drum being mounted for rotation about an axis parallel to the axis of the stacking wheel and having an annular circumferential slot, the stacking wheel being spaced from the drum by a distance such that the extremity of the stacking wheel enters the said slot and being driven at a lower peripheral speed than the drum and in a direction opposite to that of the drum and such that the slots trail in the direction of rotation, the drum incorporating port means which communicate with a source of vacuum and are so disposed that a sheet continues to be held on the drum surface by the vacuum until the said stacking wheel extremity in the slot, by virtue of its lower peripheral speed, acts against the vacuum to strip the sheet from the drum.

This positive dynamic stripping of the sheet from a vacuum drum by the spirally slotted wheel ensures that the sheet enters the slot and continues to be fed into the slot in a uniform manner and is therefore very advantageous for flimsy or creased sheets such as used banknotes.

Of course, sheet transport using vacuum drums is well known; in one type, vacuum is applied to ports throughout the circumference of the drum and in another type vacuum, generally a higher level of vacuum, is applied to ports only over a predetermined angle of the drum by means of an air commutator system. With the former type of vacuum drum, it is, of course, not possible selectively to route a sheet through a multiple drum system by vacuum control and it is necessary to provide static or pivotal diverters. To the best of our knowledge, however, a vacuum drum has not previously been used to feed a spirally slotted wheel so that the wheel strips the sheet from the drum against the vacuum.

It will be clear that apparatus according to the invention offers a considerable advantage when it is desired to handle worn or damaged sheets, such as used banknoteds. The note is held on the drum by the vacuum up to the moment that it encounters the stripping wheel. Moreover, because the vacuum acts on the entire note during transport on the drum, some air leakage through porous or damaged notes is tolerated and the notes are still handled in a satisfactory manner. If a perforated or torn banknote were conveyed by a vacuum drum with an air commutator, there would be a risk that the resulting air leakage would reduce the overall gripping efficiency of the drum, with the result that the banknote might be skewed or otherwise displaced during its travel. Additionally, contrary to apparatus employing belt feed systems, apparatus according to the present invention enables operations to be performed on the notes as the drum rotates, for example a reading operation, a condition-sensing operation or the removal of mistimed or damaged notes.

In one form of apparatus, a biased pressure plate engages the end face of the stack remote from the wheel and moves in a direction parallel to the support surface as sheets are delivered to the stack.

In another form of the apparatus, no mobile pressure plate is used to support the end of the stack, the stacking wheel being rotatably mounted upon a shaft which is in turn mounted for controlled arcuate movement about the axis of the vacuum drum. As the stack size increases, the stacking wheel shaft undergoes such arcuate movement to accommodate the increasing stack, the intermesh between the extremity of the wheel and the grooves of the vacuum drum being maintained during the arcuate movement. The stacking wheel may be arranged to float against the front face of the stack by a suitable biassing means and to move arcuately as the stack builds up. Alternatively, the arcuate movement of the stacking wheel may be positively effected by powered means in accordance with stored numerical data derived from the number of sheets in the stack. Thus, in this embodiment, the rear face of the stack may be fixedly located, or if desired, sheets can be fed independently from the end of the stack remote from the stacking wheel by a further sheet feeding device. Such a facility is extremly useful in those forms of sheet handling apparatus which incorporate a buffer sheet storage system. In this form of apparatus, the starting and terminating problems which have previously necessitated the use of a retractable mobile stack support device for each end of the stack, are overcome.

Preferably a plurality of substantially identical stacking wheels are provided in spaced axial relationship upon a common driven shaft, and associated annular grooves are provided in the vacuum drum for the receipt of the extremities of the said wheels.

Preferably the stacking wheels are of approximately the same diameter as the vacuum drum and are driven in the opposite direction via a reduction ratio of between 1:5 and 1:2, with respect to the drum. We have found that a twelve-slot stacking wheel driven at 1:3 reduction ratio satisfactorily decelerates sheets from a four-station vacuum drum.

BRIEF DESCRIPTION OF THE DRAWINGS

In order that the invention may be better understood, two examples of an apparatus embodying the invention and suitable for handling banknotes will now be described with reference to the accompanying drawings, in which.

DETAILED DESCRIPTION OF THE INVENTION

Figure 1:
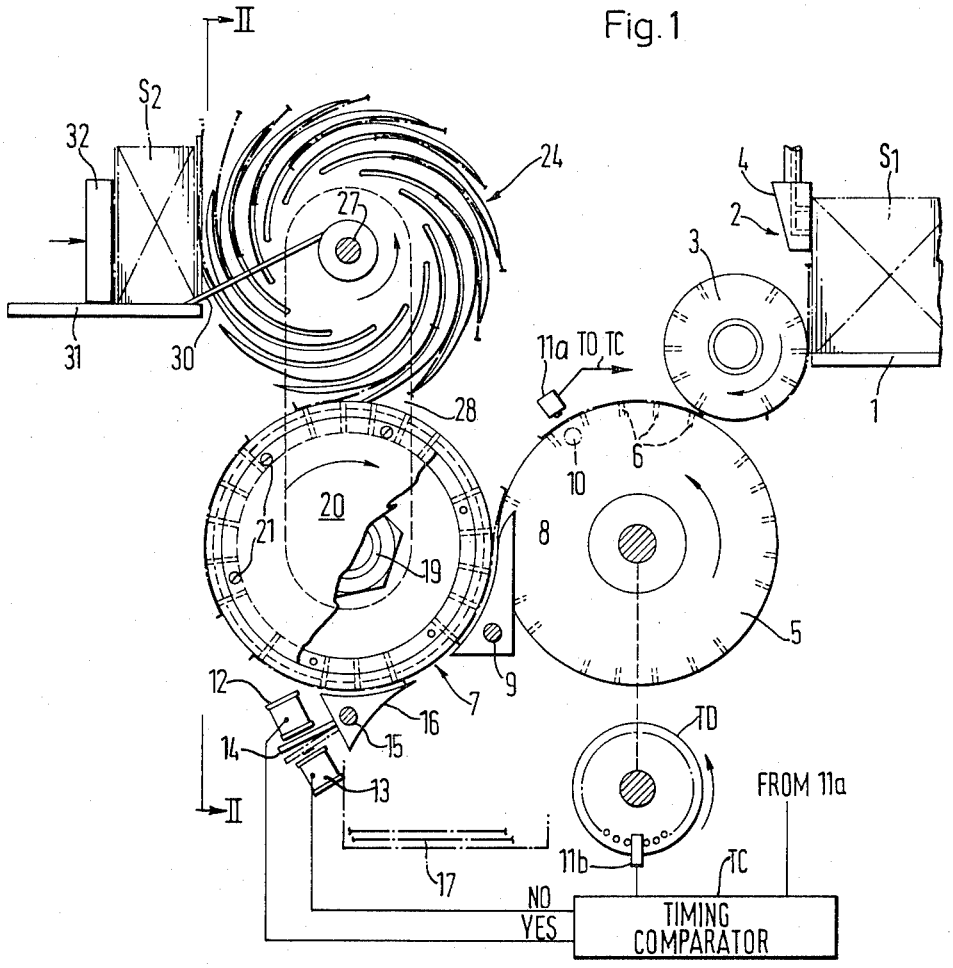
FIG. 1 is a schematic side elevation of a first embodiment.

In FIG. 1, banknotes are removed from the front face of a stack S1, disposed on edge upon a horizontal support surface 1, by means of a primary feeding device, generally indicated by symbol 2. The type of feeding device used is not critical to the invention provided it is capable of delivering the banknotes one at a time into a flowline in timed relationship. A particularly suitable feeder is described in U.K. Pat. No. 938,212 which, briefly, comprises a radially ported vacuum wheel 3, driven in a clockwise direction, and adapted to feed the frontmost banknote across the face of the stack. In the feeder shown in this prior specification, means are provided to impart compound curvature to the banknote during feeding to assist the separation of the banknote from the remainder of the stack. Also, the feeding of banknotes is controlled by means of a vacuum holding pad 4, which serves to release a note to the effect of the wheel 3, in a time-controlled manner, thereby to form precise gaps between adjacent notes fed along the flowline.

Notes removed from the stack are transferred to a pair of axially spaced transportation drums, a first of which is indicated by symbol 5. These drums are provided with four circumferentially spaced sheet-holding stations, each of which comprises a plurality of radial vacuum ports 6. A second vacuum transportation drum 7, driven in a clockwise direction, is provided adjacent to drums 5 to receive the notes therefrom. It will be appreciated that the vacuum wheel 3 and the vacuum drums 5 and 7 are driven at a common peripheral speed and that stationary, air-commutator devices of known type are provided to connect the vacuum ports of 3 and 5 to a source of vacuum through predetermined angles of rotation thereby to effect the sequential transference of the notes in a continuous manner. To assist the transference between the drums 5 and 7 an aligned assemblage of curved static divertor plates 8 are provided. These are mounted upon a transverse rod 9 which is fixedly mounted to the framework of the apparatus by means not shown. It will further be appreciated that the rotary items 3, 5 and 7 are correctly phased with each other and are simultaneously driven, for example, by a notched belt system. The said system also includes switching means for activating the vacuum holding pad 4.

To check that notes are correctly timed and positioned prior to their transference to the vacuum drum 7 a light source 10 and an associated photoelectric device 11*a* are provided to view the notes whilst they are disposed on the vacuum drum 5. Datum clock signals are derived from a photoelectric device 11*b* which senses the passage of the holes of a ring of holes formed on a timing disc TD driven in unison with the drum drive system. Output signals derived from the device 11*a* are compared in a timing comparator TC with the clock signals, thereby to generate a "YES" or "NO" decision output signal. The latter signal is time delayed and amplified to drive a selected one of two solenoids 12 and 13 respectively, which serve to actuate an armature 14 mounted upon a transverse shaft 15, upon which is carried a plurality of divertor blades 16. Thus a correctly placed note will result in a "YES" signal which will energise solenoid 12 and a misplaced note will create a "NO" decision signal and solenoid 13 will divert the said note into a reject tray 17.

The vacuum transportation drum 7, referred to above, comprises a hollow cylindrical body 18 (see also FIG. 2) mounted for rotation upon a stationary tubular stub-shaft 19 fixedly mounted to the structure of the apparatus (not shown). The drum has a diameter of 160 mm, a length of 216 mm and a wall thickness of approximately 12 mm. Suitable anti-friction bearings are provided within the left-hand end of the drum and a detachable cover plate 20, which is retained by screws 21, is provided to seal the other end with respect to the atmosphere. A low-pressure, high flow-rate exhauster (not shown) is connected to the interior of the tubular shaft which is in turn in communication with the interior of the drum 7. An exhauster capable of creating 50 mm mercury pressure at a flow-rate of 160 $m^3$/hr was found to be satisfactory.

The drum is driven by means of a notched pulley 22, fixedly mounted to the left-hand end of the drum, and adapted to receive an internally-notched belt, forming a part of the main drive system referred to above.

Figure 3:
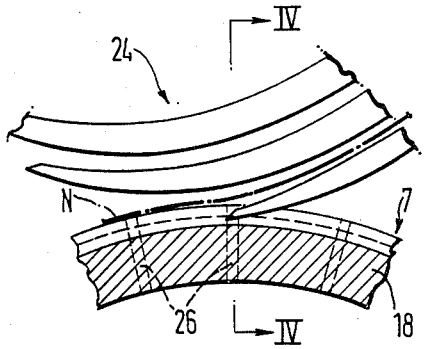
FIG. 3 is an enlarged sectional detail of parts of the apparatus of FIG. 1.
Figure 4:
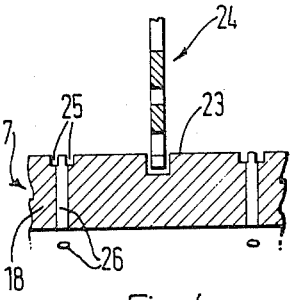
FIG. 4 is a sectional view along the plane IV—IV of FIG. 3.

The cylindrical surface of the vacuum drum is provided with five 4 mm×4 mm annular grooves 23 which are adapted to receive the extremities of five spirally-slotted stacking wheels 24, respectively. The drum is also provided with pairs of 2 mm ×2 mm annular vacuum grooves 25 (see especially FIGS. 3 and 4). Radial bores 26 are provided in the wall of the drum to connect the grooves 25 with the interior of the drum. It should be noted that the distance between the grooves of each pair of grooves 25 is less than the diameter of the radial bores 26 and accordingly the opposite sides of the bores open out into the side walls of the grooves thereby to establish fluid communication.

The stacking wheels 24 are fixedly disposed upon a shaft 27 rotatably mounted by suitable bearing means in a cast bracket member 28, which is in turn secured to the tubular shaft 19 by a clamping means 29. The vacuum drum 7 is provided with four circumferentially-spaced, note-holding stations and the stacking wheels are provided with twelve, equally spaced, identical, spiral slots, each of which is adapted to receive and convey a banknote from the surface of the vacuum drum 7. To provide synchronisation between the drum and the stacking wheels, the latter are therefore driven at a 1:3 reduction ratio with respect to the former. The extremities of the stacking wheels are arranged to overlap the vacuum drum and depend into the grooves 23 by approximately 2.5 mm. Thus in operation, the leading end of the banknote N (see FIG. 3) is lifted from the surface of the drum by a tine and is thereafter propelled into a slot by rotation of the vacuum drum 7. During further rotation of the wheels 24, the banknote will be pulled clear of the drum until it is finally ejected from the slot by means of a stationary stripping plate 30 (FIG. 1) where it is deflected away from the axis of the wheel by the following tine. Subsequent banknotes are handled in a similar manner and are assembled in a stack S2 upon a support surface 31. A spring-biassed pressure plate, 32, capable of moving along the surface of 31, is provided to control the build-up of the stack.

Figure 2:
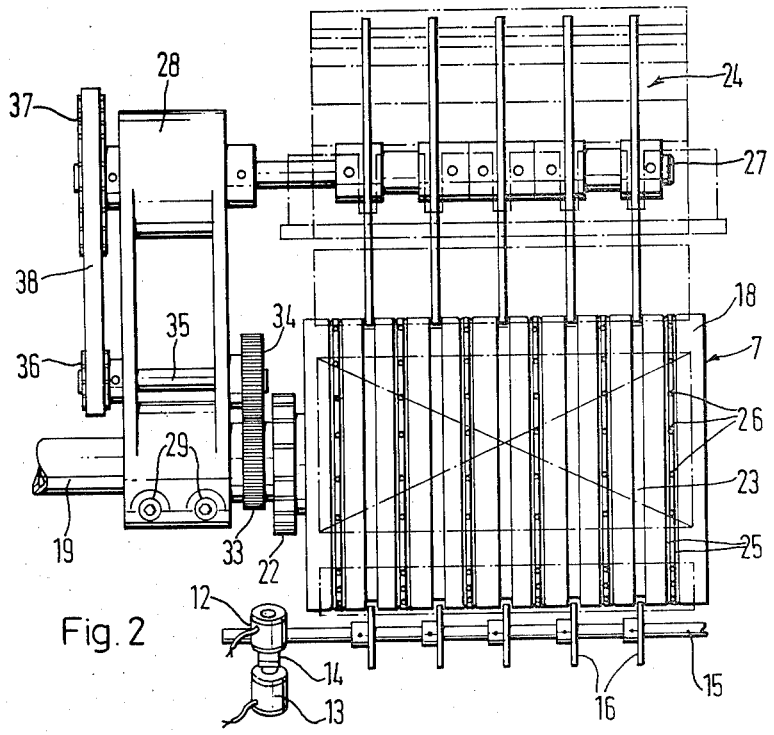
FIG. 2 is an end view along II—II of FIG. 1.

The means for driving the shaft, 27, carrying the stacking wheels 24, will now be described with reference to FIG. 2. A gear wheel 33, fixedly mounted to the outer side face of the notched pulley 22, meshes with a second gear wheel 34 of like diameter, carried upon one end of a shaft 35 which is rotatably mounted in the bracket member 28. The opposite end of the shaft 35 is provided with a notched pulley 36 which drives a further notched pulley 37, secured to the shaft 27, by means of a serrated belt 38. The pulleys 36 and 37 serve to provide a reduction ratio of 1:3 and the gear wheels 33 and 34 provide the desired direction of rotation of the stacking wheels with respect to the vacuum drum 7.

Figure 5:
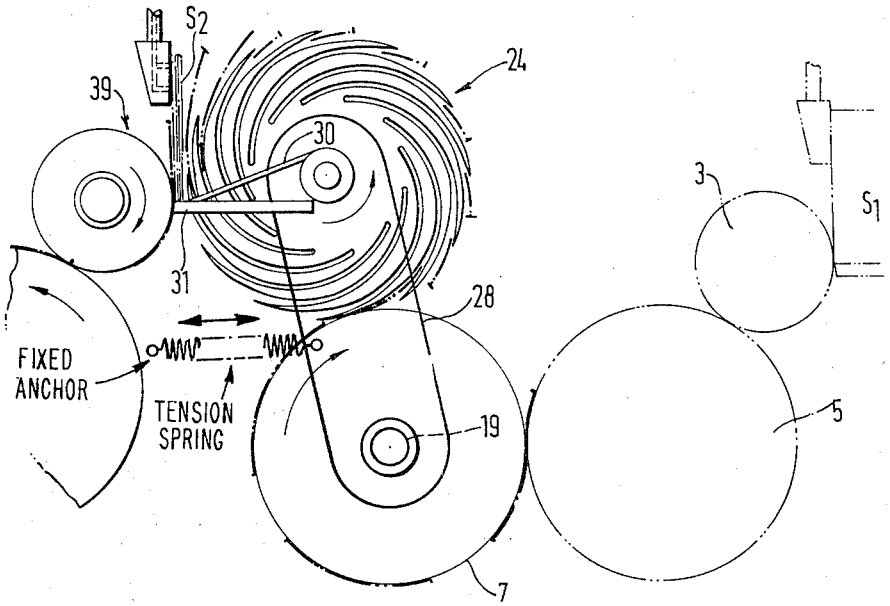
FIGS. 5 and 6 depict, in diagrammatic form two operative positions of a second embodiment of the invention.
Figure 6:
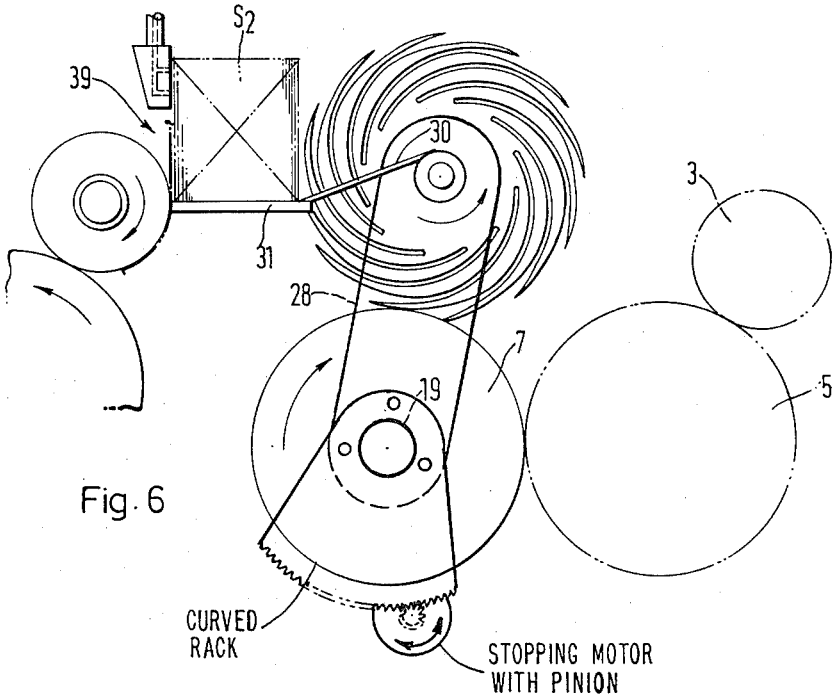

A further embodiment of the invention will now be described with reference to FIGS. 5 and 6. This embodiment utilises the supply stack S1, primary feeder 3, transportation drums 5 and 7, and stacking wheel assembly 24 described above, and accordingly these components are illustrated in outline form only. The distinction of this embodiment resides in the fact that bracket member 28 is mounted for movement in an arcuate path about the tubular shaft 19. Thus the stacking wheel assembly 24 may be moved with respect to the support surface 31 of S2, while the apparatus is in operation, without altering the intermesh between the extremities of the stacking wheels and the grooves in the periphery of the vacuum drum 7. It will further be appreciated that as the stacking wheels are positively driven from the vacuum drum the phasing and speed ratio therebetween will also be unaltered during the arcuate movement. In this embodiment the stack support surface, 31, is slotted to provide a working clearance for the stacking wheels; and the end of the stripping plate, 30, which is adapted to contact the support surface 31, is arranged to be capable of sliding thereon throughout the whole of the arcuate movement. Accordingly, the banknotes are always stripped from the stacking wheels in a tangential direction.

The bracket member 28 may be biassed towards the delivery stack S2 by suitable spring means or, alternatively, it may be actuated in a positive manner by a powered means in accordance with stored information indicative of the number of banknotes present in the stack. For example, a rack-and-pinion device driven by a reversible stepping motor may be provided to rotate the bracket member. Alternatively, a linear type motor may be arranged to effect the rotation through a suitable linkage system.

It will be appreciated that in the second embodiment the end support for the delivery stack is fixedly mounted and accordingly may compromise a feeding-out means adapted to remove banknotes from one end of the stack as other banknotes are delivered to the opposite end thereof by the stacking wheels 24. In FIGS. 5 and 6 such a feeding-out means is shown generally by symbol 39 and for the purpose of the example, is identical to the primary feeder, 2, described above.

It will thus be seen that the second embodiment has particular utility in buffer type sheet storage systems. For example, such a store may be required to count the actual quantities of banknotes contained in individual "straps" of banknotes. By means of strap identification separator sheets together with suitable electronic totalisers and associated processing equipment it is thereby possible, by means of the above described invention, to handle large quantities of banknotes in condition-verification apparatus.

Considering the broader aspect of the invention it will be appreciated that by the combination of a vacuum transportation drum and a dynamic stripping means for removing the sheets therefrom, it is possible to handle damaged or worn sheets at a high speed in a reliable manner. As mentioned above, a vacuum drum which is effective over the whole of the sheet-holding surface is designed to tolerate air leakage and, accordingly, perforated or porous sheets do not materially affect the holding power of the drum.

The invention has particular utility in connection with the rapid pre-loading of banknotes into cassettes, for example for use with automatic banknote dispensing apparatus. In such a case, it may be required to load some thousands of quality-tested banknotes into a single cassette. For such a use the cassette is releasably mounted in the apparatus so that the open end thereof is disposed towards the wheels 24, and a support surface 31 and a spring-biased pressure plate 32 are provided for and are part of each cassette. Problems may arise when formulating large stacks of banknotes, especially within cassettes, because of the force necessary to repel the pressure plate member as the stack is built up. A relatively high spring pressure is required when feeding from a fully loaded cassette when operatively installed in a cash dispenser and conversely it thus follows that the said pressure increases as the loading progresses. The second embodiment of the invention, which includes a stacking wheel having a movable axis may be arranged to operate a powdered means which serves to reduce the biasing force of the pressure member and hence to overcome the above problem.

In a practical arrangement the bracket member 28 is biased towards the front face of the stack and in the event of a build up of pressure during delivery of the banknotes the said bracket member is arranged to move away from the stack and to actuate a switching means which in turn controls the powered means. Accordingly the second embodiment of the invention may be arranged to serve as a pressure sensor thereby to enable constant pressure stacking to be effected.

We claim:

1. Apparatus for stacking flexible sheets, comprising:

a rotatable stacking wheel having slots presenting sheet-receiving openings substantially tangential to the wheel periphery and defining spiral paths for sheets fed into the slots as the wheel rotates;

a stack support means arranged for removing the sheets from the slots of the wheel and forming a stack therefrom;

a driven vacuum transportation drum for conveying the sheets from a flow path along an arcuate path to the stacking wheel, the drum being mounted for rotation about an axis parallel to the axis of the stacking wheel and having an annular circumferential slot, the stacking wheel being spaced from the drum by a distance such that the extremity of the stacking wheel enters the said slot and being driven at a lower peripheral speed than the drum and in a direction of rotation opposite to that of the drum and such that the slots of the stacking wheel trail in the direction of rotation;

a source of vacuum;

and port means in the drum which communicate with the source of vacuum and are so disposed that a sheet continues to be held on the drum surface by the vacuum until the said stacking wheel extremity in the slot, by virtue of its lower peripheral speed, acts against the vacuum to strip the sheet from the drum.

2. Apparatus as claimed in claim 1 wherein the stack support means is disposed in a substantial radial direction with respect to the axis of the stacking wheel.

3. Apparatus as claimed in claim 1 wherein the stacking wheel is rotationally mounted upon a shaft having a fixed axis and which further includes a biased pressure plate member to engage the end face of the stack remote from the wheel and to move in a direction parallel to the support surface as sheets are delivered to the stack.

4. Apparatus as claimed in claim 1, further comprising a shaft for supporting the vacuum drum, a shaft for rotatably mounting the stacking wheel, and means linking said stacking wheel shaft to said vacuum drum shaft whereby the axis of said stacking wheel shaft is movable along an arcuate path about the axis of said vacuum drum shaft.

5. Apparatus as claimed in claim 4 wherein a spring means is provided to control the arcuate movement.

6. Apparatus as claimed in claim 4 including a fixed support member for engaging the end face of the stack remote from the stacking wheel, the arrangement being such that the axis of the stacking wheel moves progressively away from the fixed support member as sheets are delivered to the stack.

7. Apparatus as claimed in claim 6, wherein the fixed support member comprises a sheet feeding means adapted to remove sheets one at a time from the end of the stack remote from the wheel.

8. Apparatus as claimed in claim 4 wherein the stack support means and a biased pressure plate for engaging the end face of the stack remote from the wheel are part of a cassette into which the stack is to be loaded.

9. Apparatus as claimed in claim 8, comprising a switch controlled by the movement of the said link, and powered means responsive to actuation of the switch to effect the said arcuate movement.

10. Apparatus as claimed in claim 4, further comprising means for sensing the quantity of sheets present in the stack, and powered means responsive to the sensing means to effect arcuate movement of the said stacking wheel shaft about the vacuum drum shaft.

11. Apparatus as claimed in claim 1, wherein the peripheral velocity of the stacking wheel is between ½ and 1/5 of the peripheral velocity of the vacuum drum.

12. Apparatus as claimed in claim 1 wherein the overall diameter of the stacking sheel and the vacuum drum are substantially equal.

13. Apparatus as claimed in claim 1 wherein the stack support means is part of a cassette into which the sheets are to be loaded.

14. Apparatus as claimed in claim 1, including a plurality of stacking wheels disposed in axially spaced relationship, the peripheries thereof being arranged to enter into a corresponding plurality of the said annular circumferential slots formed in the vacuum transportation drum system.

* * * * *